United States Patent [19]

Behnk

[11] 3,989,214

[45] Nov. 2, 1976

[54] WALL BRACKET ASSEMBLY

[76] Inventor: Donald J. Behnk, 2341 Sample Road, Allison Park, Pa. 15101

[22] Filed: Nov. 14, 1975

[21] Appl. No.: 631,878

[52] U.S. Cl. ..... 248/223

[51] Int. Cl.[2] ..... F16M 13/00

[58] Field of Search ..... 248/73, 223, 224, 225, 248/243, 244, 249, 295, 302, 303

[56] References Cited

UNITED STATES PATENTS

| | | | |
|---|---|---|---|
| 2,059,429 | 11/1936 | Anderson | 248/73 |
| 3,288,414 | 11/1966 | Fortunato | 248/223 |

FOREIGN PATENTS OR APPLICATIONS

| | | | |
|---|---|---|---|
| 689,793 | 6/1964 | Canada | 248/249 |
| 1,143,310 | 2/1963 | Germany | 248/243 |
| 148,074 | 12/1954 | Sweden | 248/249 |
| 365,192 | 12/1962 | Switzerland | 248/243 |

*Primary Examiner*—William H. Schultz
*Attorney, Agent, or Firm*—Paul Bogdon

[57] ABSTRACT

A wall bracket assembly including an upright support or standard and a load supporting bracket is disclosed. The upright support has a back section which may be fixed to a wall surface and two side sections connected by a wall, together defining a U-shaped channel. The bracket has an inner end section shaped to fit in the U-shaped channel. When in the load bearing position, a portion of the inner end section of the bracket engages one of a plurality of longitudinally spaced abutments on the back wall of the support while a curved section of the inner end section snugly engages an upright rib formed on one of the side walls of the support while yet another section engages the front wall joining the sides. The inner section is shaped such that when the bracket is pivoted in an upwardly direction, the inner end sections disengage from the abutment and rib freeing the bracket for movement upwardly or downwardly of the support. Pivoting the bracket downwardly secures the bracket in a fixed relationship to the support.

7 Claims, 8 Drawing Figures

44
43
46
42
38
40
34
32
36

14
13
20
18
24
10
26
44
34
32
36

12
40
16
14
13
52
18
22
22
12

20
24
52
26
40
18
34

24
13
16
36
32
32
50

WALL BRACKET ASSEMBLY

BACKGROUND OF THE INVENTION

This invention relates to a wall bracket assembly the essential elements of which are an upright support or standard and a load bearing bracket. Such assemblies are old and well-known, and are used extensively. Most of such assemblies are deficient in various respects, the most prominent deficiency being the inability to simply and easily reposition the bracket along the standard. In many cases the brackets are permanently fixed to the standards while in other cases the brackets may be repositioned after fasteners such as nuts and bolts are removed. There are arrangements which are designed to allow easy positioning of the brackets, but those arrangements require somewhat elaborate and expensive standards. In addition, those arrangements are usually designed for supporting light loads mainly because of the high cost of producing such arrangements designed for heavy loading.

The present invention overcomes the above noted problems and drawbacks of existing wall bracket assembly designs and provides an assembly which is simple in structure, allows simple and easy positioning of the bracket with respect to the standard, and may be designed for supporting light and heavy loads while maintaining its basic simple design. Thus, the present invention is attractive to the market since it is easily adjustable requiring no special tools or fasteners to adjust the bracket position and reasonably inexpensive to manufacture.

SUMMARY OF THE INVENTION

The present invention provides a wall bracket assembly which preferably comprises: an upright support or standard having a back section which may be secured to a wall surface or the like, a first side section extending from one edge of the back section, a section side section spaced from first side section and extending inwardly to define a channel with the first side section, and an outer wall joining the outer ends of the first and second side sections. Thus, the standard is generally L-shaped with a U-shaped channel at the end section of the side leg of the L. A rib is formed on the inner end of the second side section and extends longitudinally of that side section, while a plurality of uniformly and longitudinally spaced abutments are provided on the back section of the bracket. The assembly also includes a load supporting bracket extending laterally from the standard. The inner end section of the bracket is shaped to engage the top of one of the abutments when the bracket is in the load supporting position. Also, the inner end section has a portion shaped to be received within the U-shaped channel with an upper portion of the inner end shaped to engage the outer wall and an intermediate section shaped to engage the rib formed on the second side when the bracket is in the load supporting position. The inner end section of the bracket, the U-shaped channel, and the lower abutment-engaging end of the bracket are constructed and arranged such that when the bracket is pivoted upwardly the intermediate section of the bracket disengages from the rib and the lower end disengages from the abutment permitting downward and upward positioning of the bracket with respect to the standard.

The standard of the present invention may be formed from a single length of sheet metal while the bracket may also be formed from a single length of metal rod. In both cases the manufacturing operations are reasonably simple and inexpensive as compared with elaborate and complex extrusions.

The present invention may be designed for supporting light loads on shelves, for example, or a single bracket may be designed to support heavy objects such as rolls of wire rod, tires, or the like. Regardless of whether the present invention is to be used for light or heavy loads the basic shape will remain the same. In other words, major design changes are not required of the present invention to make it capable of heavy load supporting as compared with light load supporting.

Various other advantages, details and modifications of the present invention will become apparent as the following description of a certain present preferred embodiment thereof proceeds.

BRIEF DESCRIPTION OF THE DRAWINGS

In the accompanying drawings I have shown a certain present preferred embodiment of the present invention in which.

Figures 1, 2, 3, 4, 8:
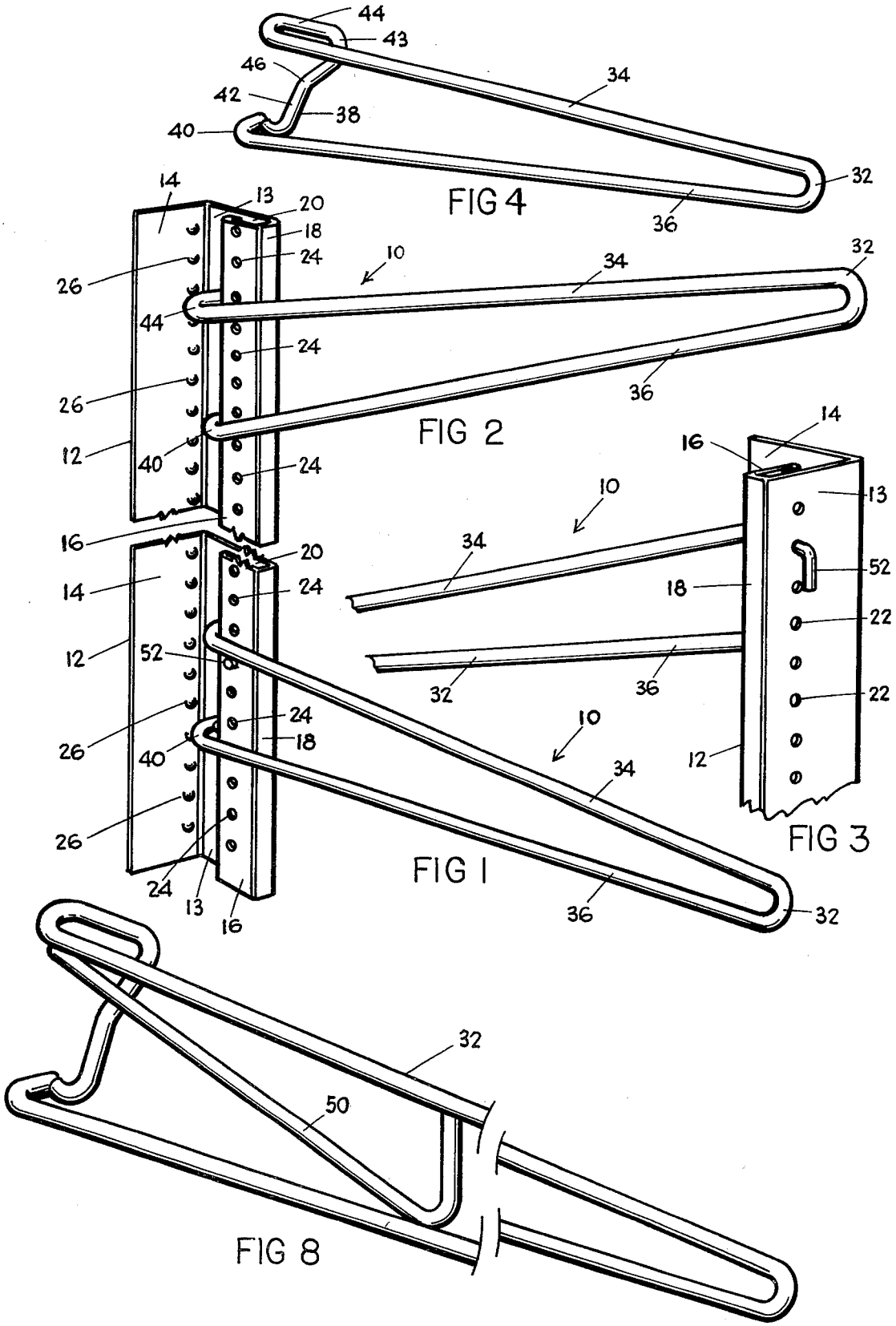
FIG. 1 is a partial perspective view of the wall bracket assembly embodying the present invention showing the bracket in the load supporting position with respect to the standard.
FIG. 2 is a partial perspective view similar to that of FIG. 1 showing the bracket pivoted upwardly and in a position to be moved upwardly or downwardly with respect to the standard.
FIG. 3 is a partial perspective view of the wall bracket assembly of FIGS. 1 and 2, showing clearly the outer face of one side of the standard, the openings formed in that side, and a locking pin arranged in one of the openings.
FIG. 4 is a perspective view of the bracket forming part of the present invention and clearing showing the inner end section of the bracket.
FIG. 8 is a partial perspective of a relatively long bracket with a truss provided to give added strength to the bracket.
Figure 7:
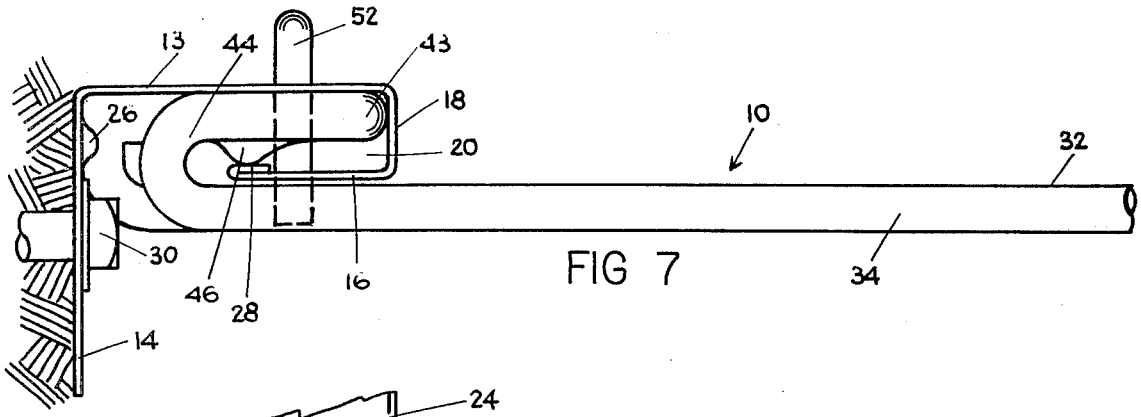
FIG. 7 is a top plan view of the assembly as shown in FIG. 6.
Figure 6:
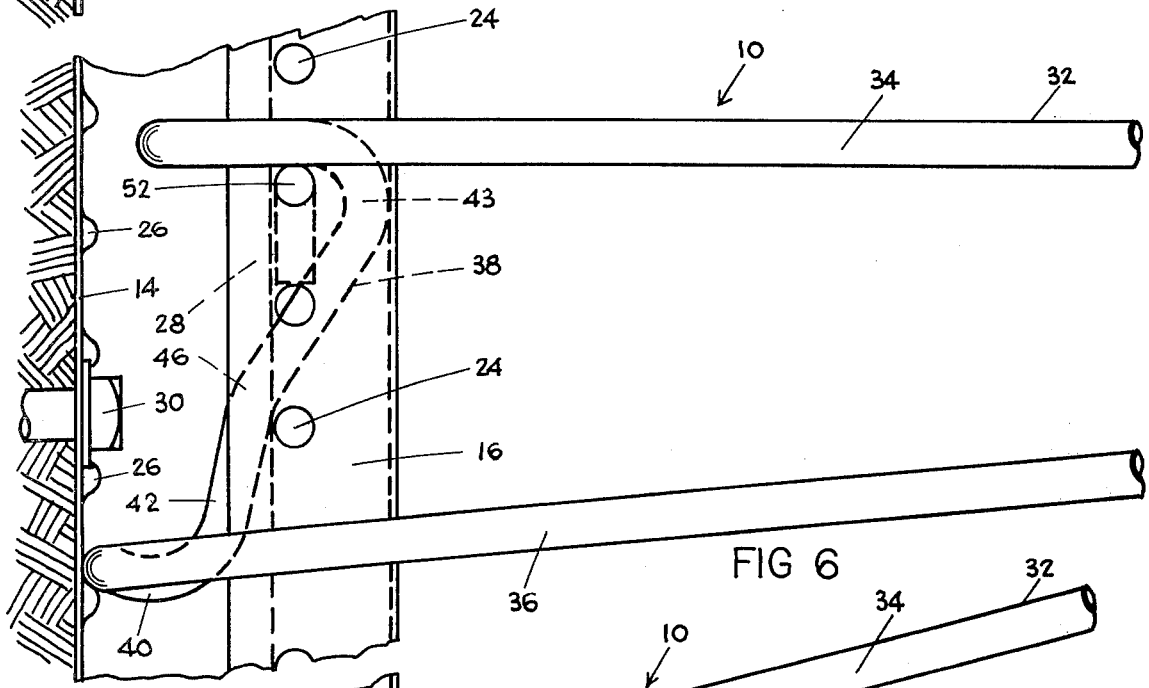
FIG. 6 is a partial side elevation view similar in every detail to that of FIG. 5 showing the bracket in the load receiving position with respect to the standard.
Figure 5:
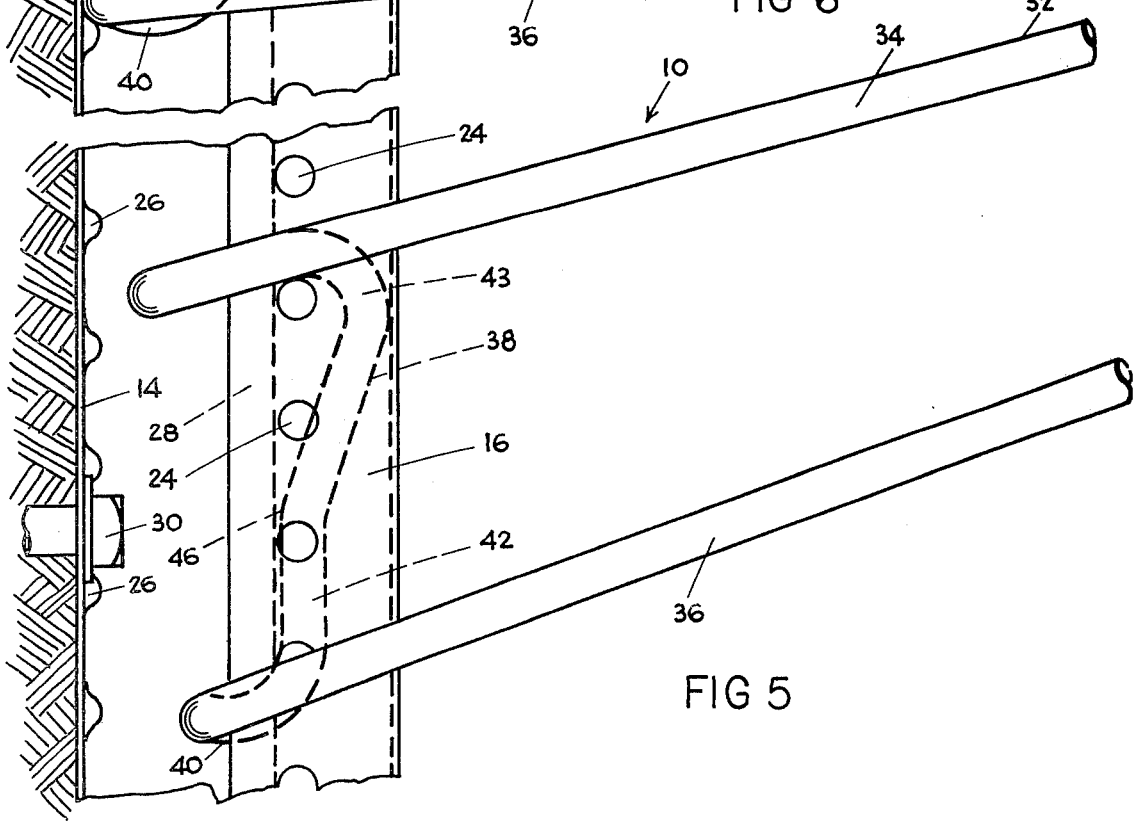
FIG. 5 is a partial side elevation view of the wall bracket assembly of the earlier views, enlarged to show details of construction and shown with the standard anchored to a wall surface, and further showing the bracket pivoted upwardly and in a position to be moved upwardly or downwardly with respect to the standard.

Referring now to the drawings, and particularly to FIGS. 1–7, there is shown a wall bracket assembly embodying the present invention and generally designated by the numeral 10. The wall bracket assembly 10 includes an elongated upright support or standard 12 formed from sheet steel or the like in a generally L-shaped configuration. Standard 12 has a flat back section 14, a first side section 13 extending transversely from one side of the back section, a second side section 16 spaced from and parallel to the first side section, and an outer wall 18 joining the outer ends of the side sections. The second side section 16 extends inwardly to a point intermediate the ends of the first side section 13, as is clearly shown in FIGS. 1, 2 and 7. The first and second side sections 13 and 16, and the outer wall 18 define a generally U-shaped channel 20. As clearly shown in FIG. 3, the first side section 13 has a plurality of longitudinally, uniformly spaced openings 22 formed therethrough. The openings 22 are arranged toward the outer end portion of the first side section 13 and are located to be coaxial with a plurality of longitudinally, uniformly spaced openings 24 formed through the second side section 16. A plurality of hemispherically shaped, longitudinally, uniformly spaced abutments 26 are formed on the outer face of the back section 14. The abutments 26 are aligned with the center of the U-shaped channel 20 as is clearly shown in FIG. 7. The inner edge of the second side section 16 is turned into the channel 20 to form a lip or rib 28 which extends over the entire back surface of the second side section. The rib 28 is clearly shown in FIGS. 5–7, and serves as a cam surface or enlargement for cooperating with the bracket portion of this invention as will be further described hereinafter. The standard 12 may be secured to a wall surface by means of anchors 30 as shown in FIGS. 5–7.

The wall bracket assembly 10 also includes a load supporting bracket generally designated by the numeral 32. Bracket 32, as illustrated in FIGS. 1–7, is formed from a single length of metal rod, and has an upper or load bearing section 34 which extends around a curved outer end to a lower section 36 which in turn extends to an inner end section 38. The inner end section 38 has a lower portion 40 which is bent outwardly in a generally co-planar relationship to the lower section 36 and is formed such that its inner end engages the upper surface of an abutment 26 on the back section 14 when the bracket 32 is in the load supporting position as clearly shown in FIGS. 1 and 6, to thereby act as a securing means for the bracket in the load supporting position. A mid-section 42 extends obliquely upwardly from the lower section 36 to an upper portion 44 which bends inwardly to join the inner end of the upper or load bearing section 34. The upper region 43 of the mid-section 42 is formed with a smooth radius to engage the outer wall 18 of the standard 12 when the bracket 32 is in the load supporting position as clearly shown in FIGS. 6 and 7. The mid-section 42 is also provided with a curved cam section 46 intermediate its ends, which cam section 46 is arranged and shaped to snugly engage the rib 28 formed on the second side section 16 to firmly secure the mid-section between the side walls as shown in FIGS. 6 and 7 when the bracket 32 is in the load supporting position. The cam section 46 is also appropriately shaped to be free of any engagement with the second side section 16 when the bracket 32 is pivoted upwardly in the relationship to the standard 12 as shown in FIG. 5 whereby the mid-section 46 is loosely fitted within the channel 20 and the bracket thus free to be moved upwardly or downwardly of the standard. As shown in FIGS. 1, 2, 5–7 the inner end section 38 of bracket 32 is shaped such that it aligns over its entire length with the channel 20 defined between the first and second side sections 13 and 16, with the entire mid-section 42 fitting within the channel 20 in the unsecured position of bracket 32 as shown in FIG. 5 and a major portion of the mid-section fitting within the channel when the bracket is in the load supporting position.

In using the wall bracket assembly 10, the bracket 32 would be aligned at its inner end section 38 with channel 20 at the open top of the standard 12 so that the mid-section 42 would be loosely received in the channel in the fashion shown in FIG. 5. The bracket 32 is free to be lowered to a desired position along the standard 12. At that desired position the bracket 32 would be pivoted downwardly about a point on the upper region 43 as it engages the outer wall 18 until the cam section 46 snugly engages the rib 28 and the inner end of lower section 36 engages the upper surface of an abutment 26, while the upper region 43 remains in contact with the outer wall 18. In that position the bracket 32 is ready to support a load. In repositioning the bracket 32 relative to the standard 12, the reverse operation is followed. That is, the bracket 32 is pivoted upwardly about upper region 43 until the cam section 46 is released from the rib 28 and the inner end of lower section 36 is to disengage from the abutment 26. It is to be noted that the inner section 38 is shaped such that engagements and disengagements as just described occur substantially simultaneously.

As indicated earlier, the wall bracket assembly 10 of the present invention may be designed for supporting light as well as heavy loads without any necessity of changing the essential features of the invention as described above. The assembly 10 may be arranged with pairs of standards 12 fixed parallel to each other whereby shelving could be supported by the brackets 32. A single standard 12 could be used so that items could be hung on a bracket 32. The brackets 32 could be varied in length and if it is desired to have a long bracket, for example three or four feet long, a support truss 50 or the like could be arranged between the upper and lower sections of the bracket, as shown in FIG. 8, to give added strength to the bracket. Although only one bracket has been shown in its relationship to the standard, it should be apparent that several brackets may be used with a single standard.

In order to prevent the bracket 32 from moving downwardly with respect to the standard 12 in the event of an inadvertent upward pivoting of the bracket, one leg of a removable L-shaped locking pin 52 is inserted through an opening 22 in the first side section 13 and similarly through an opposite opening 24 in the second side section 16. The locking pin 52 may be unlocked and removed when it is desired to reposition a bracket 32 with respect to the standard 12.

Although the assembly of the present invention has been described with the load supporting bracket 32 initially mated with the standard 12 by aligning it with the open top of the standard (i.e. top loading) it is to be understood that a side loading of the bracket with the standard is within the scope of this invention. In other words, the bracket 32 may be mated with the standard 12 by inserting the inner end section 38 directly into channel 20 defined by the side sections 13 and 16. In order to achieve side loading the space between the back section 14 and the inner end of the second side section 16 would be appropriately designed to accomodate the inner end section 38 of the bracket 32 so that it can be received in the channel 20.

It should now be clearly understood how the advantages of the present invention as specified in the introductory portion of this specification are achieved.

While I have shown and described a certain preferred embodiment of this invention, it is to be distinctly understood that the invention is not limited thereto, but may be otherwise variously embodied within the scope of the following claims.

I claim:

1. A wall bracket assembly comprising an upright support having a back section, a first side section extending outwardly from one side of said back section, a second side section spaced from said first side section to define a channel therebetween and extending inwardly from the outer end of said first side section to an inner end position disposed at a point intermediate the ends of said first side section, and an outer wall joining the outer ends of said first and second side sections;

enlargement means on one of said side sections arranged within said channel;

a plurality of longitudinally spaced abutments on said back section;

a load supporting bracket extending laterally from said support;

securing means on the inner end section of said bracket for engaging an upper portion of at least one of said abutments when said bracket is in the load supporting position with said support;

said inner end section of said bracket having at least a portion thereof received within said channel with an upper portion of said inner end section shaped to engage said outer wall and an intermediate section shaped to engage said enlargement means to snugly secure a major portion of said inner end section within said channel when said bracket is in its load supporting position, with said inner end section, said channel, and said securing means being so constructed and arranged that when said bracket is pivoted upwardly said intermediate section disengages from said enlargement means and said securing means disengages from said abutment permitting downward and upward positioning of said bracket with respect to said support.

2. A wall bracket assembly as set forth in claim 1 wherein said enlargement means is an upright rib member continuously extending over a major portion of the length of said side section to which it is secured.

3. A wall bracket assembly as set forth in claim 1 wherein said enlargement means is arranged on said second side section.

4. A wall bracket assembly as set forth in claim 2 wherein said rib member is arranged on said second side section.

5. A wall bracket assembly as set forth in claim 1 wherein said securing means is on the lower portion of said inner end section of said bracket.

6. A wall bracket assembly as set forth in claim 1 including removable locking means cooperating with at least said second side section to lock said bracket against downward movement with respect to said support.

7. A wall bracket assembly as set forth in claim 1 including strengthening means arranged between the ends of said bracket for increasing the load bearing strength of said bracket.

* * * * *